United States Patent [19]

Meier

[11] Patent Number: 4,911,663

[45] Date of Patent: Mar. 27, 1990

[54] WEED MIGRATION REDUCTION SYSTEM

[75] Inventor: Peter W. Meier, Stuart, Fla.

[73] Assignee: Outboard Marine Corporation, Waukegan, Ill.

[21] Appl. No.: 328,243

[22] Filed: Mar. 24, 1989

[51] Int. Cl.[4] ..... B63H 5/12

[52] U.S. Cl. ..... 440/49; 440/73; 416/93 A; 416/146 R

[58] Field of Search ..... 440/49, 73, 78, 88, 440/89; 416/93 A, 146 R, 146 B

[56] References Cited

U.S. PATENT DOCUMENTS

| | | | |
|---|---|---|---|
| 2,609,783 | 9/1952 | Kiekhaefer | 440/49 |
| 3,279,415 | 10/1966 | Kiekhaefer | 416/93 A |
| 4,236,872 | 12/1980 | Metcalf | 416/146 R |
| 4,295,835 | 10/1981 | Mapes et al. | 440/89 |
| 4,436,514 | 3/1984 | Takahashi et al. | 440/89 |
| 4,447,214 | 5/1984 | Henrich | 440/89 |
| 4,486,181 | 12/1984 | Cavil | 440/49 |

*Primary Examiner*—Sherman D. Basinger
*Assistant Examiner*—Jesûs D. Sotelo
*Attorney, Agent, or Firm*—Michael, Best & Friedrich

[57] ABSTRACT

Discussed herein is an arrangement for reducing migration of weeds into an area between the gearcase and the propeller hub of a marine propulsion device. The arrangement is intended to reduce the problem of weed migration when a small hub propeller is used.

21 Claims, 3 Drawing Sheets

WEED MIGRATION REDUCTION SYSTEM

BACKGROUND OF THE INVENTION

This invention relates generally to marine propulsion devices, and, more particularly, to arrangements for reducing migration of weeds into an area between the gearcase and the propeller hub of a marine propulsion device.

In marine propulsion devices, such as outboard motors and stern drive units, a rotatable propeller shaft is typically supported in a lower unit by means of a propeller shaft bearing housing. The propeller shaft is adapted to receive thereon the inner hub of a propeller. When a propeller is mounted on the propeller shaft, an outer hub of the propeller extends somewhat into the hollow interior of the gearcase that contains the propeller shaft bearing housing, ideally in close proximity to the inner cylindrical surface of the gearcase, to substantially prevent the entry of weeds.

When a propeller is used having an outer hub of reduced size, however, such as the propeller sold under the trademark "Shooter" by the assignee of this invention, migration of weeds into the area between the gearcase and the propeller hub of the marine propulsion device can become a problem.

Attention is directed towards the following U.S. Pat. Nos.

| | | |
|---|---|---|
| Kiekhaefer | 2,609,783 | May 11, 1951 |
| Metcalf | 4,236,872 | December 2, 1980 |
| Mapes et al. | 4,295,835 | October 20, 1981 |
| Henrich | 4,447,214 | May 8, 1984 |
| Cavil | 4,486,181 | December 4, 1984 |

SUMMARY OF THE INVENTION

The invention provides a marine propulsion device comprising a lower unit including a gearcase housing having a hollow interior and an inner cylindrical surface at the rearward end thereof, a rotatable propeller receiving means extending rearwardly from within the gearcase and adapted to receive a propeller adapted for mounting on the propeller receiving means to effect common rotation of the propeller with the propeller receiving means, the propeller including an outer hub having an outer cylindrical surface with a diameter substantially less than the diameter of the inner cylindrical surface of the gearcase, and the marine propulsion device further including a hollow, generally cylindrical weed ring resiliently mounted to the lower unit with the propeller receiving means passing therethrough, the weed ring comprising an inner generally cylindrical surface, an open forward end, an open rearward end to allow reception of a portion of the outer hub of the propeller in close proximity radially interiorly to the inner surface of the weed ring when the propeller is installed on the propeller receiving means, an outer cylindrical surface, and means extending from the weed ring proximate to the forward end for resiliently engaging the lower unit and retaining the forward end of the weed ring radially interiorly of the inner cylindrical surface of the gearcase housing.

In one aspect of the invention a marine propulsion device is provided comprising a lower unit including a gearcase housing having a hollow interior and an inner cylindrical surface at the rearward end thereof, a rotatable propeller receiving means extending rearwardly from within the gearcase and adapted to receive a propeller adapted for mounting on the propeller receiving means to effect common rotation of the propeller with the propeller receiving means, the propeller including an outer hub having an outer cylindrical surface with a diameter substantially less than the diameter of the inner cylindrical surface of the gearcase, and the marine propulsion device further including a hollow, generally cylindrical weed ring resiliently mounted to the lower unit with the propeller receiving means passing therethrough, the weed ring comprising an inner generally cylindrical surface, an open forward end, an open rearward end to allow reception of a portion of the outer hub of the propeller in close proximity radially interiorly to the inner surface of the weed ring when the propeller is installed on the propeller receiving means, an outer cylindrical surface, means extending from the weed ring proximate to the forward end for resiliently engaging the lower unit and retaining the forward end of the weed ring radially interiorly of the inner cylindrical surface of the gearcase housing, and the weed ring further comprising means for restricting rotation of the weed ring relative to the gearcase housing.

In one aspect of the invention a marine propulsion device is provided comprising a lower unit including a gearcase housing having a hollow interior and an inner cylindrical surface at the rearward end thereof, and a radially inwardly facing labyrinth seal formed in the inner cylindrical surface, a rotatable propeller receiving means extending rearwardly from within the gearcase and adapted to receive a propeller adapted for mounting on the propeller receiving means to effect common rotation of the propeller with the propeller receiving means, the propeller including an outer hub having an outer cylindrical surface with a diameter substantially less than the diameter of the inner cylindrical surface of the gearcase, and the marine propulsion device further including a hollow, generally cylindrical weed ring resiliently mounted to the labyrinth seal with the propeller receiving means passing therethrough, the weed ring comprising an inner generally cylindrical surface, an open forward end, an open rearward end to allow reception of a portion of the outer hub of the propeller in close proximity radially interiorly to the inner surface of the weed ring when the propeller is installed on the propeller receiving means, an outer cylindrical surface, and resilient retention means extending from the outer cylindrical surface, and proximate to the forward end, the resilient retention means engaging the labyrinth seal and retaining the forward end of the weed ring radially interiorly of the labyrinth seal.

In one aspect of the invention, a hollow, generally cylindrical weed ring is provided for resilient mounting to a labyrinth seal of a marine propulsion device, the weed ring comprising an inner generally cylindrical surface, an open forward end, an open rearward end to allow reception of a portion of an outer hub of a propeller in close proximity radially interiorly to the inner surface of the weed ring when the weed ring and the propeller are in use, an outer cylindrical surface, and resilient retention means extending from the outer cylindrical surface, proximate to the forward end, for engaging the labyrinth seal and for retaining the forward end of the weed ring radially interiorly of the labyrinth seal.

In one aspect of the invention a marine propulsion device is provided comprising a lower unit including a gearcase housing having a hollow interior and an inner cylindrical surface at the rearward end thereof, a tube within the gearcase housing, a rib extending from the tube to the gearcase housing, a rotatable propeller receiving means extending rearwardly from within the tube and adapted to receive a propeller adapted for mounting on the propeller receiving means to effect common rotation of the propeller with the propeller receiving means, the propeller including an outer hub having an outer cylindrical surface with a diameter substantially less than the diameter of the inner cylindrical surface of the gearcase, and the marine propulsion device further including a hollow, generally cylindrical weed ring mounted to the lower unit with the propeller receiving means passing therethrough, the weed ring comprising an inner generally cylindrical surface, an open forward end, an open rearward end to allow reception of a portion of the outer hub of the propeller in close proximity radially interiorly to the inner surface of the weed ring when the propeller is installed on the propeller receiving means, an outer cylindrical surface, means extending from the weed ring proximate to the forward end for restricting rotation of the weed ring relative to the gearcase housing, and means for resiliently engaging the rib and retaining the forward end of the weed ring radially interiorly of the inner cylindrical surface of the gearcase housing.

In one aspect of the invention, a hollow, generally cylindrical weed ring is provided for resilient mounting to a lower unit of a marine propulsion device, the lower unit being of the type having a gearcase housing with a hollow interior and an inner cylindrical surface at the rearward end thereof, a tube within the gearcase housing, and a rib extending from the tube to the gearcase housing, the weed ring comprising an inner generally cylindrical surface, an open forward end, an open rearward end to allow reception of a portion of an outer hub of a propeller in close proximity radially interiorly to the inner surface of the weed ring when the weed ring and the propeller are in use, an outer cylindrical surface, means extending from the weed ring, proximate to the forward end for restricting rotation of the weed ring relative to the gearcase housing, and means for resiliently engaging the rib to retain the forward end of the weed ring radially interiorly of the inner cylindrical surface.

Other principal features of the invention will become apparent to those skilled in the art upon review of the following detailed description of the preferred embodiment, claims and drawings.

Figure 1:
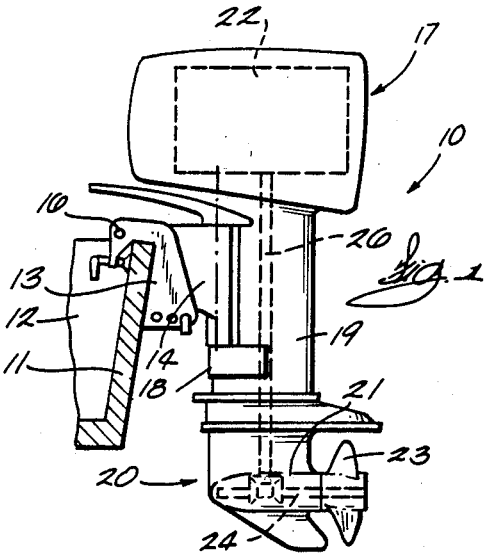
FIG. 1 is a side elevational view of a marine propulsion device which includes a weed migration reduction system and which embodies various of the features of the invention.

Before two embodiments of the invention are explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for purposes of description and should not be regarding as limiting.

GENERAL DESCRIPTION

A marine propulsion device 10 embodying the invention is illustrated in the drawings. As best shown in FIG. 1, the marine propulsion device 10 comprises a mounting assembly fixedly attached to the transom 11 of a boat 12. While various suitable mounting assemblies can be employed, in the preferred embodiments, the mounting assembly includes a transom bracket 13 fixedly attached to the transom 11, and a swivel bracket 14 mounted on the transom bracket 13 for pivotal movement of the swivel bracket 14 relative to the transom bracket 13 around a generally horizontal tilt axis 16.

The marine propulsion device 10 also comprises a propulsion unit 17 mounted on the swivel bracket 14 for pivotal movement of the propulsion unit 17 relative to the swivel bracket 14 about a generally vertical steering axis 18. The propulsion unit 17 includes a lower unit 19 having a gearcase assembly 20 comprising a gearcase housing 21 which includes an interior cavity. The propulsion unit 17 further includes an internal combustion engine 22 mounted on the lower unit 19. The lower unit 19 further includes means for supporting a propeller. More particularly, a propeller shaft 24 is rotatably mounted within the gearcase housing 21, is drivingly connected to the internal combustion engine 22 by means of a driveshaft 26, and is adapted to support a propeller 23.

DESCRIPTION OF THE FIRST PREFERRED EMBODIMENT OF THE INVENTION

Figure 2:
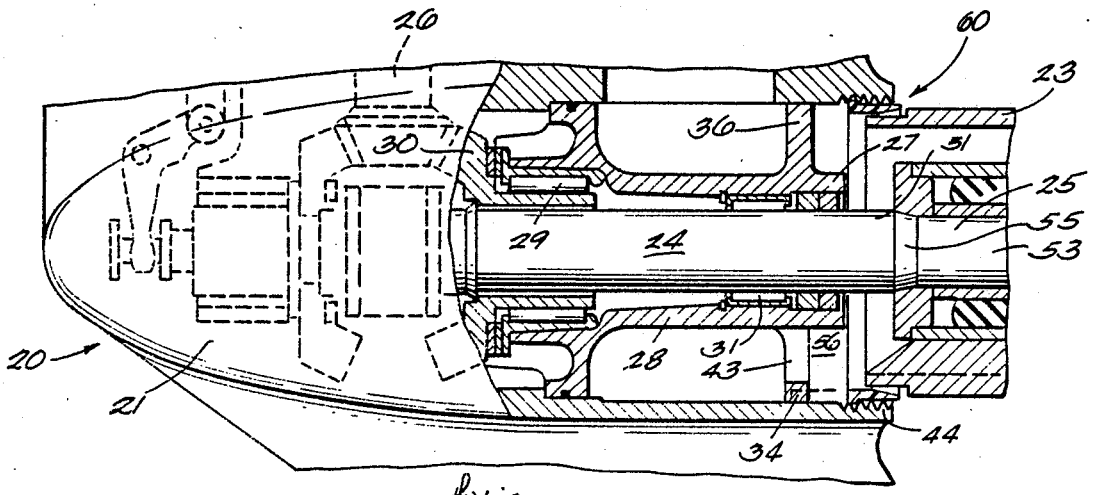
FIG. 2 is a side elevational view, partially in section, of a lower unit and a weed ring as utilized in a first embodiment of the invention.

The gearcase assembly 20 of the first embodiment of the invention is shown in detail in FIG. 2 and includes an elongate propeller shaft bearing housing 27 rotatably supporting the propeller shaft 24 within the interior cavity of the gearcase housing 21. The propeller shaft bearing housing 27 includes a hollow, substantially cylindrical tube 28 having therein mounted one or more bearing assemblies 31 for rotatably supporting the propeller shaft 24, and an additional bearing assembly 29 for supporting a gear 30 positioned around, and selectively engageable with, the propeller shaft 24. The propeller shaft 24 includes a rearward portion 25 extending aft of the bearing housing 27.

The bearing housing 27 also includes an outer annular portion 34 which engages a part of the substantially cylindrical tube 28 of the gearcase housing 21 and which is supported from tube 28 by one or more ribs 36-for instance, three equi-angularly spaced ribs 36 can be included in the lower unit. Between the shaft tube 28, the outer annular portion 34, and the ribs 36 are a plurality of openings 43 through which exhaust gases and engine cooling water are discharged from the gearcase assembly 20.

A labyrinth seal 44 is provided aft of outer annular portion 34, and comprising a series of non-helical parallel grooves machined into the inner cylindrical surface of the rearward portion of the gearcase housing 21, as is known in the art.

The propeller shaft portion 25 extending rearwardly of the bearing housing 27 includes a forward part 51 having a first diameter, a rearward part 53 having a second diameter of less dimension than the first diameter, and a thrust receiving transition portion 55 located between the forward part 51 and the rearward part 53 and which, in the disclosed construction is conical in formation, but could be of other configurations.

The rearward portion of the propeller shaft 24 is shown having mounted thereon, rearwardly of the thrust receiving part 55, the propeller 23 which has an inner hub for reception on the propeller shaft 24, and an outer hub from which propeller blades extend, a portion of the outer hub extending axially proximate the area 56 rearward of the outer annular portion 34 defined by the labyrinth seal 44.

A weed ring 60 is shown mounted to the labyrinth seal 44 and partially surrounding a portion of the propeller 23. The weed ring 60 is meant to be used with propellers having an outer hub with a diameter substantially less than the diameter of the rearward portion of the gearcase housing 21, such as a propeller sold under the trademark "Shooter" owned by the assignee of this invention.

Figure 5:
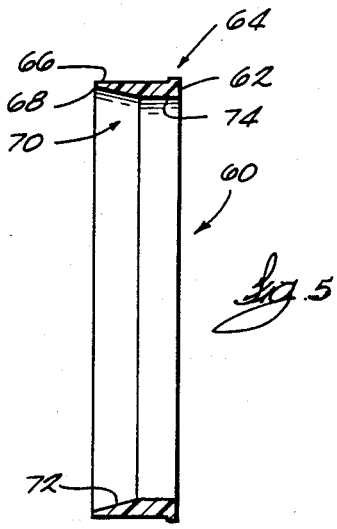
FIG. 5 is a sectional view taken along line 5—5 of FIG. 4.
Figure 3:
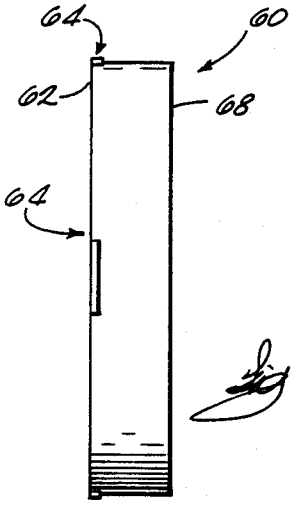
FIG. 3 is a side elevational view of the weed ring used in the lower unit of FIG. 2.
Figure 4:
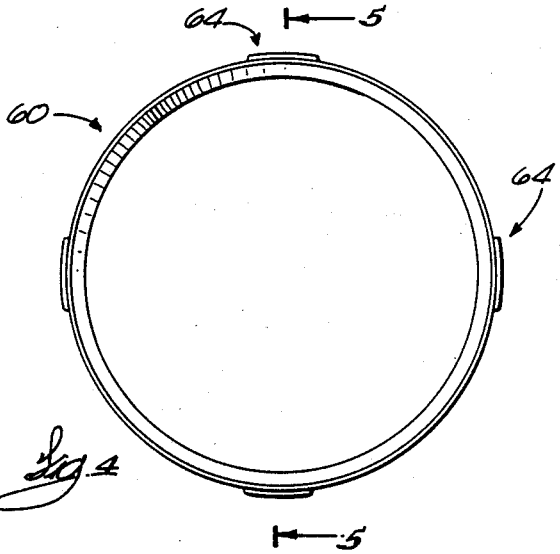
FIG. 4 is a front elevational view of the weed ring of FIG. 3.

Referring to FIGS. 3-5, the weed ring 60 can be seen in detail. The weed ring 60 has a forward end 62, a plurality of resilient retention means, and an outer cylindrical surface 66. The weed ring 10 is adapted to be snapped into a position wherein the forward end 62 is retained in intimate relation radially interiorly to labyrinth seal 44 by the plurality of resilient retention means. Each resilient retention means comprises a protrusion 64 extending from the outer surface 66 of weed ring 60, at the forward end 62, and arranged to engage the grooves in the labyrinth seal 44. The rearward end 68 of the weed ring 60 is adapted to receive, within the area defined by a generally cylindrical inner surface 70 and in close proximity to the inner surface 70, the portion of the outer hub of the propeller which extends axially proximate the area 56 previously defined.

Optionally, but preferably, the inner surface 70 of the weed ring 60 includes an outwardly tapered portion 72 at the rearward end 68 extending from a non-tapered portion 74 at the forward end 62.

Optionally, but preferably, four equi-angularly spaced protrusions 64 are provided, all of which are axially aligned to engage the same groove in the plurality of grooves comprising labyrinth seal 44.

Figure 6:
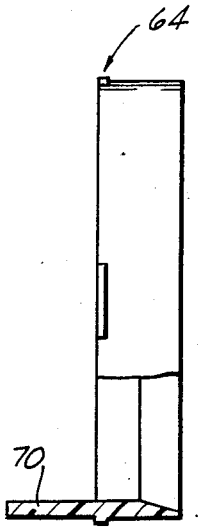
FIG. 6 is a side elevational view of the weed ring which is shown in FIG. 3 and which further includes means for preventing rotation of the weed ring relative to the lower unit.
Figure 7:
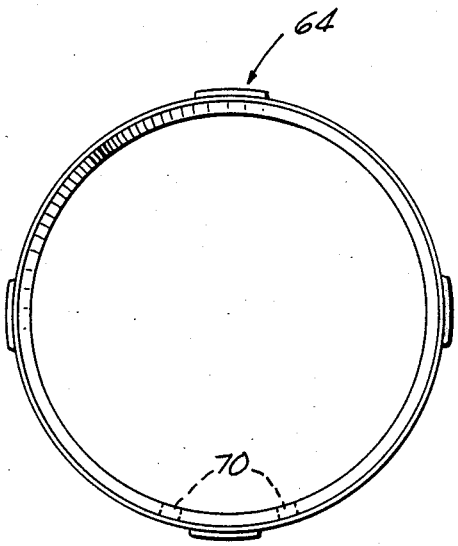
FIG. 7 is a front elevational view of the weed ring of FIG. 6.

Referring now to FIGS. 6 and 7, a weed ring can be seen which is identical to the one shown in FIGS. 3-5, previously described, but which is further provided with means to restrict rotation. While various means could be provided, preferably fingers 70 extend from the forward end 62 of the weed ring 60. The fingers 70 are positioned to receive therebetween one of the ribs 36 within gearcase housing 21, and thereby prevent rotation of the weed ring 60 relative to the gearcase housing 21.

DESCRIPTION OF THE SECOND PREFERRED EMBODIMENT OF THE INVENTION

Figure 8:
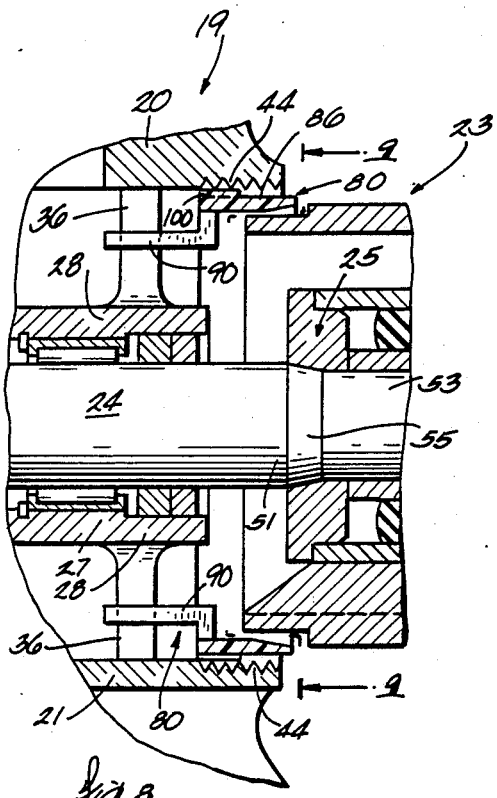
FIG. 8 is a side elevational view, partially in section, of a lower unit and a weed ring as utilized in a second embodiment of the invention.

Referring now to FIG. 8, the lower unit 19 and the propeller 23 of the second embodiment of the invention are substantially identical to the corresponding components of the first embodiment of the invention, and thus will not be described in significant detail.

The lower unit 19 of the second embodiment of the invention comprises two ribs 36 between the tube 28 and the gearcase housing 21, which ribs are shown to be angularly separated by 180°. Resiliently mounted to the ribs 36 is a weed ring 80 of the second embodiment of the invention. A portion of the weed ring 80 partially surrounds the propeller 23 when the weed ring 80 and the propeller 23 are mounted to the lower unit 19. The weed ring 80 is meant to be used with propellers having an outer hub with a diameter substantially less than the diameter of the rearward portion of the gearcase housing 21, such as the propeller sold under the trademark "Shooter".

Figure 9:
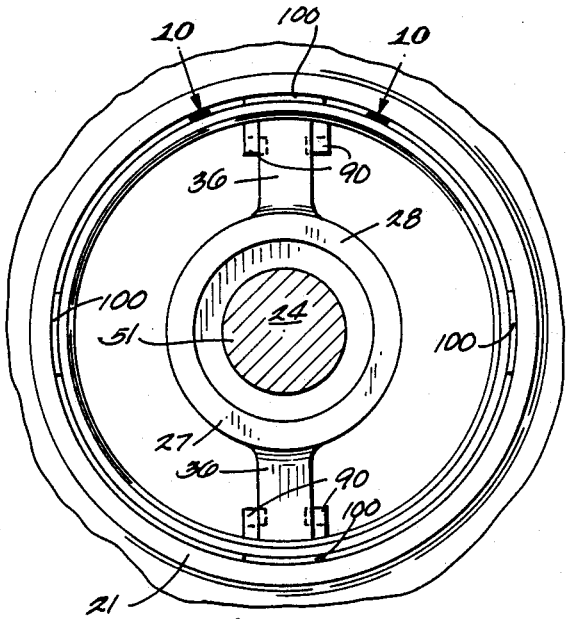
FIG. 9 is a sectional view taken along line 9—9 of FIG. 8.
Figure 11:
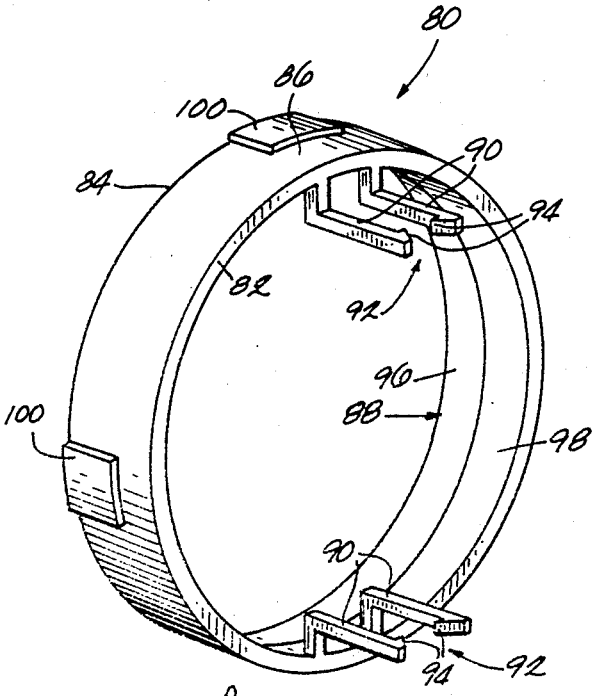
FIG. 11 is a perspective view of a weed ring used in the lower unit of FIG. 8.
Figure 10:
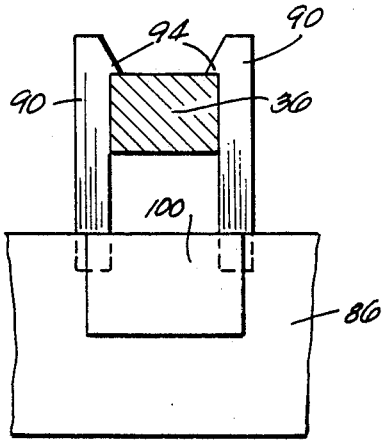
FIG. 10 is a sectional view taken along line 10—10 of FIG. 9.

Referring to FIGS. 9-11, the weed ring 80 can be seen in detail. The weed ring 80 has a forward end 82, a rearward end 84, a cylindrical outer surface 86, and an inner generally cylindrical surface 88.

The weed ring 80 further comprises means for restricting rotation of the weed ring relative to the gearcase housing. While other constructions can be employed, in the construction shown in FIGS. 8-11, the means for restricting rotation comprises forward facing fingers 90 extending from the weed ring 80. At least some of the forward facing fingers 90 are included in pairs 92 of fingers 90 angularly spaced to straddle one of the ribs 36. Preferably, the weed ring 80 comprises two pairs 92 of fingers 90.

The weed ring 80 further comprises means for resiliently engaging the lower unit 19 and retaining the forward end 82 of the weed ring 80 radially interiorly of the inner cylindrical surface of the rearward portion of the gearcase housing 21. While other constructions can be employed, in the construction shown in FIGS. 8-11, the means for resiliently engaging the lower unit comprises a protrusion 94 extending from each finger 90, and oriented to partially embrace one of the ribs 36. Preferably, protrusions 94 are included in at least two pairs 92 of fingers 90.

Optionally, but preferably, the inner surface 88 of the weed ring 80 includes an outwardly tapered portion 96 at the rearward end 84 extending from a non-tapered portion 98 at the forward end 82 of the weed ring 80.

Also optionally, but preferably, a plurality of radially spaced raised sections 100 may be provided about the outer surface 86 of the weed ring 80, proximate the forward end 82, to aid in centering the weed ring 80 relative to the gearcase housing 21.

Two preferred embodiments of the invention have now been outlined which provide arrangements for reducing migration of weeds into an area between the gearcase and the propeller hub of a marine propulsion device. The weed rings of the first and second preferred embodiments of the invention are attachments that can be easily snapped into place, when a small hub propeller is used, to reduce the problem of weed migration.

Although the weed migration reduction arrangements have been shown and described in the context of an outboard motor, it will be appreciated that the weed migration reduction arrangements can also be used in other types of marine propulsion devices such as stern drive units.

Various of the features and advantages of the invention are set forth in the following claims.

I claim:

1. A marine propulsion device comprising a lower unit including a gearcase housing having a hollow interior and an inner cylindrical surface at the rearward end thereof, a rotatable propeller receiving means extending rearwardly from within said gearcase and adapted to receive a propeller adapted for mounting on said propeller receiving means to effect common rotation of the propeller with said propeller receiving means, the propeller including an outer hub having an outer cylindrical surface with a diameter substantially less than the diameter of said inner cylindrical surface of said gearcase, and the marine propulsion device further including a generally cylindrical weed ring resiliently mounted to said lower unit with said propeller receiving means passing therethrough, said weed ring comprising an inner generally cylindrical surface, an open forward end, an open rearward end to allow reception of a portion of the outer hub of the propeller in close proximity radially interiorly to said inner surface of said weed ring when the propeller is installed on the propeller receiving means, an outer cylindrical surface, and means extending from said weed ring proximate to said forward end for resiliently engaging said lower unit and retaining said forward end of said weed radially interiorly of said inner cylindrical surface of said gearcase housing.

2. A marine propulsion device in accordance with claim 1 and further including means for restricting rotation of said weed ring relative to said gearcase housing.

3. A marine propulsion device in accordance with claim 2 and further including a tube within said gearcase housing and surrounding a portion of said propeller receiving means, a rib extending from said tube to said gearcase housing, and wherein said means for restricting rotation comprises at least one forward facing finger extending from said weed ring for engagement against said rib.

4. A marine propulsion device in accordance with claim 1 wherein said inner surface of said weed ring includes a non-tapered portion at said forward end, and an outwardly tapered portion at said rearward end and extending from said non-tapered portion.

5. A marine propulsion device comprising a lower unit including a gearcase housing having a hollow interior and an inner cylindrical surface at the rearward end thereof, a rotatable propeller receiving means extending rearwardly from within said gearcase and adapted to receive a propeller adapted for mounting on said propeller receiving means to effect common rotation of the propeller with said propeller receiving means, the propeller including an outer hub having an outer cylindrical surface with a diameter substantially less than the diameter of said inner cylindrical surface of said gearcase, and the marine propulsion device further including a generally cylindrical weed ring resiliently mounted to said lower unit with said propeller receiving means passing therethrough, said weed ring comprising an inner generally cylindrical surface, an open forward end, an open rearward end to allow reception of a portion of the outer hub of the propeller in close proximity radially interiorly to said inner surface of said weed ring when the propeller is installed on the propeller receiving means, an outer cylindrical surface, means extending from said weed ring proximate to said forward end for resiliently engaging said lower unit and retaining said forward end of said weed ring radially interiorly of said inner cylindrical surface of said gearcase housing, and said weed ring further comprising means for restricting rotation of said weed ring relative to said gearcase housing.

6. A marine propulsion device in accordance with claim 5 and further including a tube within said gearcase housing and surrounding a portion of said propeller receiving means, a rib extending from said tube to said gearcase housing, and wherein said means for restricting rotation comprises at least one forward facing finger extending from said weed ring for engagement against said rib.

7. A marine propulsion device in accordance with claim 5 wherein said inner surface of said weed ring includes a non-tapered portion at said forward end, and an outwardly tapered portion at said rearward end and extending from said non-tapered portion.

8. A marine propulsion device comprising a lower unit including a gearcase housing having a hollow interior and an inner cylindrical surface at the rearward end thereof, and a radially inwardly facing labyrinth seal formed in said inner cylindrical surface, a rotatable propeller receiving means extending rearwardly from within said gearcase and adapted to receive a propeller adapted for mounting on said propeller receiving means to effect common rotation of the propeller with said propeller receiving means, the propeller including an outer hub having an outer cylindrical surface with a diameter substantially less than the diameter of said inner cylindrical surface of said gearcase, and the marine propulsion device further including a generally cylindrical weed ring resiliently mounted to said labyrinth seal with said propeller receiving means passing therethrough, said weed ring comprising an inner generally cylindrical surface, an open forward end, an open rearward end to allow reception of a portion of the outer hub of the propeller in close proximity radially interiorly to said inner surface of said weed ring when the propeller is installed on the propeller receiving means, an outer cylindrical surface, and resilient retention means extending from said outer cylindrical surface, and proximate to said forward end, said resilient retention means engaging said labyrinth seal and retaining said forward end of said weed ring radially interiorly of said labyrinth seal.

9. A marine propulsion device in accordance with claim 8 and further including means for restricting rotation of said weed ring relative to said gearcase housing.

10. A marine propulsion device in accordance with claim 9 and further including a tube within said gearcase housing and surrounding a portion of said propeller receiving means, a rib extending from said tube to said gearcase housing, and wherein said means for restricting rotation comprises a forwardly facing finger extending from said weed ring for engagement with said rib.

11. A marine propulsion device in accordance with claim 10 and further including, angularly spaced from said forwardly facing finger, a second forwardly facing finger extending from said weed ring with said rib being received between said forwardly facing fingers.

12. A marine propulsion device in accordance with claim 8 wherein said inner surface of said weed ring includes a non-tapered portion at said forward end, and an outwardly tapered portion at said rearward end and extending from said non-tapered portion.

13. A generally cylindrical weed ring for resilient mounting to a labyrinth seal of a marine propulsion device, said weed ring comprising an inner generally cylindrical surface, an open forward end, an open rearward end to allow reception of a portion of an outer hub of a propeller in close proximity radially interiorly to said inner surface of said weed ring when the weed ring and the propeller are in use, an outer cylindrical surface, and resilient retention means extending from said outer cylindrical surface, proximate to said forward end, for engaging the labyrinth seal and for retaining said forward end of said weed ring radially interiorly of the labyrinth seal.

14. A weed ring in accordance with claim 13 and further including means for restricting rotation thereof relative to said labyrinth seal.

15. A marine propulsion device comprising a lower unit including a gearcase housing having a hollow interior and an inner cylindrical surface at the rearward end thereof, a tube within said gearcase housing, a rib extending from said tube to said gearcase housing, a rotatable propeller receiving means extending rearwardly from within said tube and adapted to receive a propeller adapted for mounting on said propeller receiving means to effect common rotation of the propeller with said propeller receiving means, the propeller including an outer hub having an outer cylindrical surface with a diameter substantially less than the diameter of said inner cylindrical surface of said gearcase, and the marine propulsion device further including a generally cylindrical weed ring mounted to said lower unit with said propeller receiving means passing therethrough, said weed ring comprising an inner generally cylindrical surface, an open forward end, an open rearward end to allow reception of a portion of the outer hub of the propeller in close proximity radially interiorly to said inner surface of said weed ring when the propeller is installed on the propeller receiving means, an outer cylindrical surface, means extending from said weed ring proximate to said forward end for restricting rotation of said weed ring relative to said gearcase housing, and means for resiliently engaging said rib and retaining said forward end of said weed ring radially interiorly of said inner cylindrical surface of said gearcase housing.

16. A marine propulsion device in accordance with claim 15 wherein said means for resiliently engaging said rib extends from said means for restricting rotation of said weed ring.

17. A marine propulsion device in accordance with claim 15 wherein said means for restricting rotation comprises a pair of forwardly facing fingers extending from said weed ring with said rib being received between said forwardly facing fingers, and wherein said retaining means comprises a protrusion extending from each finger and oriented to partially embrace said rib.

18. A marine propulsion device in accordance with claim 17 and further including a second rib extending from said tube to said gearcase housing in angularly spaced relation from said first mentioned rib, and a second pair of forwardly facing fingers extending from said weed ring in angularly spaced relation from said first mentioned pair of forwardly facing fingers, and straddling said second rib, and said retaining means further including a protrusion extending from each finger of said second pair of forwardly facing fingers and oriented to partially embrace said second rib.

19. A marine propulsion device in accordance with claim 15 wherein said inner surface of said weed ring includes a non-tapered portion at said forward end, and an outwardly tapered portion at said rearward end and extending from said non-tapered portion.

20. A generally cylindrical weed ring for resilient mounting to a lower unit of a marine propulsion device, the lower unit being of the type having a gearcase housing with a hollow interior and an inner cylindrical surface at the rearward end thereof, a tube within said gearcase housing, and a rib extending from said tube to said gearcase housing, said weed ring comprising an inner generally cylindrical surface, an open forward end, an open rearward end to allow reception of a portion of an outer hub of a propeller in close proximity radially interiorly to said inner surface of said weed ring when the weed ring and the propeller are in use, an outer cylindrical surface, means extending from said weed ring, proximate to said forward end for restricting rotation of said weed ring relative to said gearcase housing, and means for resiliently engaging said rib to retain said forward end of said weed ring radially interiorly of said inner cylindrical surface.

21. A weed ring in accordance with claim 20 wherein said means for restricting rotation comprises a pair of forward facing fingers extending from said weed ring and spaced from each other to straddle the rib, and wherein said retaining means comprises a protrusion.

* * * * *